US010134555B2

(12) United States Patent
Durth

(10) Patent No.: US 10,134,555 B2
(45) Date of Patent: Nov. 20, 2018

(54) FUSE FOR A DEVICE TO BE PROTECTED

(71) Applicant: PHOENIX CONTACT GMBH & CO. KG, Blomberg (DE)

(72) Inventor: Rainer Durth, Horn-Bad Meinberg (DE)

(73) Assignee: PHOENIX CONTACT GMBH & CO. KG (DE)

( * ) Notice: Subject to any disclaimer, the term of this patent is extended or adjusted under 35 U.S.C. 154(b) by 0 days.

(21) Appl. No.: 15/329,310

(22) PCT Filed: Aug. 4, 2015

(86) PCT No.: PCT/EP2015/067956
§ 371 (c)(1),
(2) Date: Jan. 26, 2017

(87) PCT Pub. No.: WO2016/020381
PCT Pub. Date: Feb. 11, 2016

(65) Prior Publication Data

US 2017/0236674 A1 Aug. 17, 2017

(30) Foreign Application Priority Data

Aug. 4, 2014 (DE) ..... 10 2014 215 278

(51) Int. Cl.
*H01H 85/143* (2006.01)
*H01H 85/46* (2006.01)
(Continued)

(52) U.S. Cl.
CPC ..... *H01H 85/143* (2013.01); *H01H 85/0241* (2013.01); *H01H 85/12* (2013.01);
(Continued)

(58) Field of Classification Search
CPC ..... H01H 85/0241; H01H 2085/0283; H01H 85/143; H01H 85/38; H01H 85/46; H01H 2085/388; H01T 1/14
(Continued)

(56) References Cited

U.S. PATENT DOCUMENTS 662,466 A 11/1900 Sachs
2,504,804 A 4/1950 Clark
(Continued)

FOREIGN PATENT DOCUMENTS

DE 199 28 713 A1 1/2001
DE 10 2004 006 988 A1 6/2005
(Continued)

OTHER PUBLICATIONS

German Search Report prepared by the German Patent Office dated Mar. 26, 2014, for German Patent Application No. 10 2014 215 279.8.
(Continued)

*Primary Examiner* — Anatoly Vortman
(74) *Attorney, Agent, or Firm* — Sheridan Ross P.C.

(57) ABSTRACT

A fuse has a first contact and a second contact, with the second contact being used to electrically contact the device to be protected. The fuse has a fuse element that connects the first contact to the second contact. The fuse also has an additional contact being arranged so as to be insulated from the first contact and insulated from the second contact and, in an untripped state, is contactless with respect to the fuse element, with the first contact being directly connected to the first potential during operation and with the device to be protected being directly connected to the second potential during operation, with the additional contact also being directly connected to the second potential during operation. A fourth contact makes external triggering available, with
(Continued)

triggering resulting in an electric arc that causes the fuse element to fuse.

6 Claims, 4 Drawing Sheets

(51) Int. Cl.

| | |
|---|---|
| ***H01H 85/02*** | (2006.01) |
| ***H01H 85/38*** | (2006.01) |
| ***H01H 85/12*** | (2006.01) |
| ***H01T 1/14*** | (2006.01) |
| ***H01T 1/12*** | (2006.01) |
| ***H01T 2/02*** | (2006.01) |

(52) U.S. Cl.
CPC ..... *H01H 85/38* (2013.01); *H01H 85/46* (2013.01); *H01T 1/12* (2013.01); *H01T 1/14* (2013.01); *H01T 2/02* (2013.01); *H01H 2085/0283* (2013.01); *H01H 2085/388* (2013.01)

(58) Field of Classification Search
USPC ..... 337/295
See application file for complete search history.

(56) References Cited

U.S. PATENT DOCUMENTS

| | | | | |
|---|---|---|---|---|
| 3,256,408 | A | 6/1966 | Stumpe et al. | |
| 3,958,206 | A | 5/1976 | Klint | |
| 6,452,475 | B1 * | 9/2002 | Kawazu | H01H 85/463 29/623 |
| 6,566,995 | B2 * | 5/2003 | Furuuchi | H01L 23/5256 257/E23.149 |
| 6,671,126 | B2 * | 12/2003 | Durth | H01T 4/10 360/119.01 |
| 8,982,525 | B2 * | 3/2015 | Durth | H01C 7/12 361/111 |
| 9,088,155 | B2 * | 7/2015 | Durth | H01H 85/44 |
| 9,449,778 | B2 * | 9/2016 | Durth | H01T 1/14 |
| 2012/0243138 | A1 * | 9/2012 | Cerny | H02H 9/041 361/93.8 |
| 2012/0268850 | A1 * | 10/2012 | Rainer | H01C 7/126 361/56 |

FOREIGN PATENT DOCUMENTS

| | | | | |
|---|---|---|---|---|
| DE | 20 2006 020 213 | U1 | 1/2008 | |
| DE | 10 2011 014343 | A1 | 9/2012 | |
| DE | 20 2012 000 339 | U1 | 5/2013 | |
| DE | 102013019391 | A1 * | 10/2014 | H01T 1/14 |
| EP | 0 096 834 | A2 | 12/1983 | |
| EP | 0 940 836 | A2 | 9/1999 | |
| WO | WO 2014/065763 | A2 | 5/2014 | |

OTHER PUBLICATIONS

International Search Report prepared by the European Patent Office dated Oct. 6, 2015, for International Application No. Oct. 14, 2015.

* cited by examiner

FUSE FOR A DEVICE TO BE PROTECTED

FIELD

The invention relates to a triggerable fuse for a device to be protected.

BACKGROUND

A large number of electrical devices as well as electrical lines are protected by fuses in the event of a fault. Faults of an extremely wide variety of types can occur. The most common faults can be understood as overload faults or as short-circuit faults.

Typically, a fuse can then be tripped. The current flowing through the fuse heats the fuse element to the extent that at least partial, if not complete, fusion of the fuse element occurs. As a rule, this fusion is associated with the occurrence of an electric arc, in which case material of the fuse element vaporizes. This vapor precipitates in another location, and the electric arc is cooled to the point that the current is limited and finally shut off.

The fusion of the fuse element is determined by its material and geometric characteristics, so that, depending on the material and/or geometry of the fuse element, a respective heat quantity Q is required to vaporize the fuse element. Typically, the fusing characteristics and rated tripping currents associated therewith are described by the melting integral $I^2t$.

It should be borne in mind, however, that this current, which represents a fault condition, still flows through the device or system to be protected.

Particularly in the case of high short-circuit currents, the danger therefore exists of damage occurring that should actually be prevented, since the power limit of the device to be protected is exceeded.

In addition, it must be considered that current is flowing not only in the fusing phase of the fuse element, but also in the quenching phase.

That is, only the integration of the two current flow ranges over time results in the pass integral.

Thus, in the process of dimensioning, it is actually this pass integral that must be considered in order to avoid damage.

However, this is often erroneously neglected, thus resulting in incorrect dimensioning.

Special requirements apply if the device to be protected is an overvoltage protection device; after all, these are supposed to temporarily allow high currents to pass through without tripping the fuse, yet switch off promptly even in the event of low, lasting fault currents such as those which can occur if the overvoltage protection device is damaged, or as secondary current, for example. While the first requirement often leads to high rated current values for the fuse, the second requirement can be sensibly met only with low rated current values.

At the same time, there has been an ever-stronger trend toward small installation spaces. The requirements therefore cannot be met with existing fuses.

SUMMARY

It is therefore the object of the invention to provide an improved fuse.

BRIEF DESCRIPTION OF THE DRAWINGS

In the following, the invention is explained in further detail with reference to the enclosed drawing on the basis of preferred embodiments.

DETAILED DESCRIPTION

Figure 1:
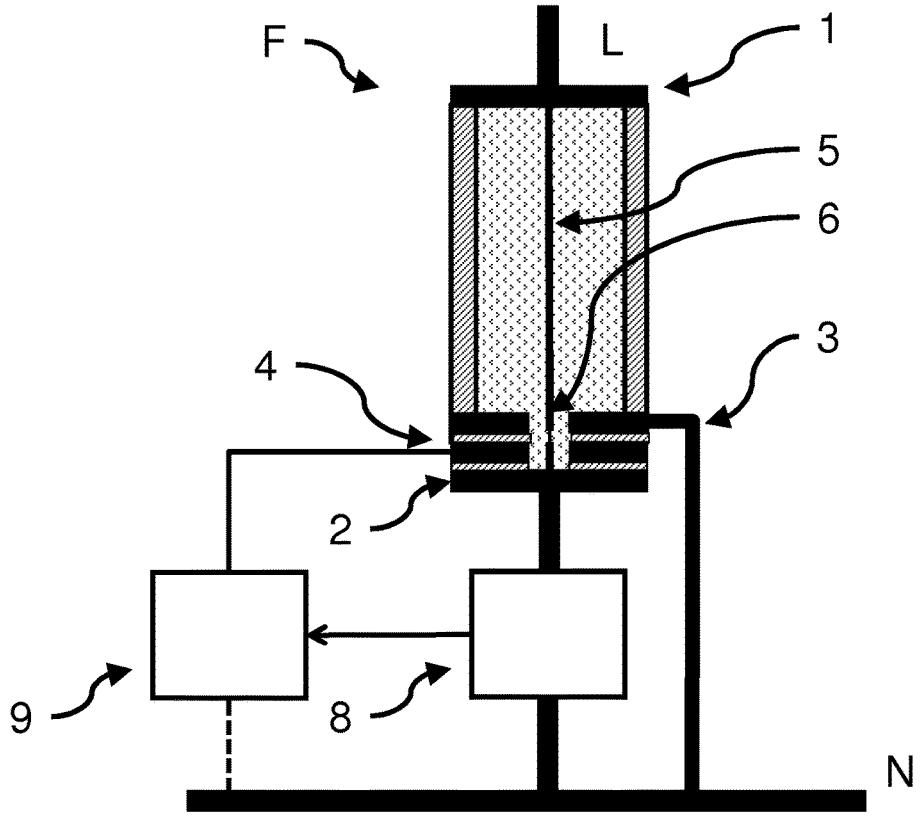
FIG. 1 shows a first embodiment of a fuse according to the invention.
Figure 2:
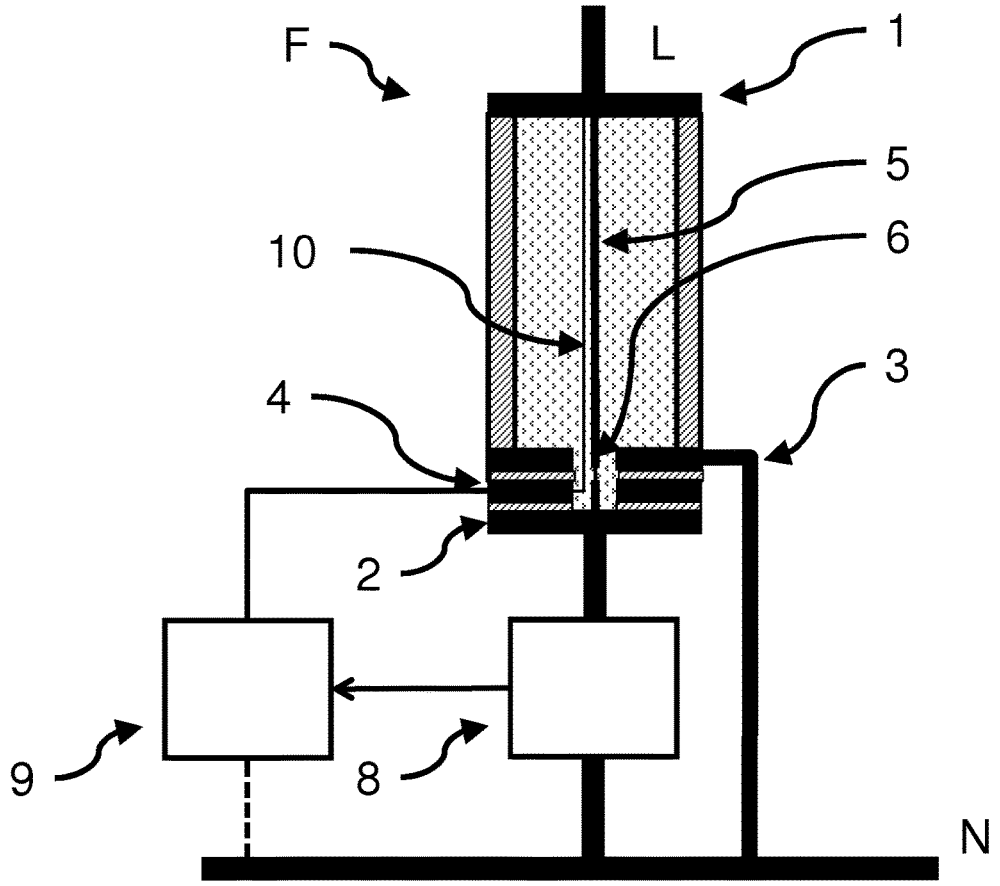
FIG. 2 shows a second embodiment of a fuse according to the invention.
Figure 4:
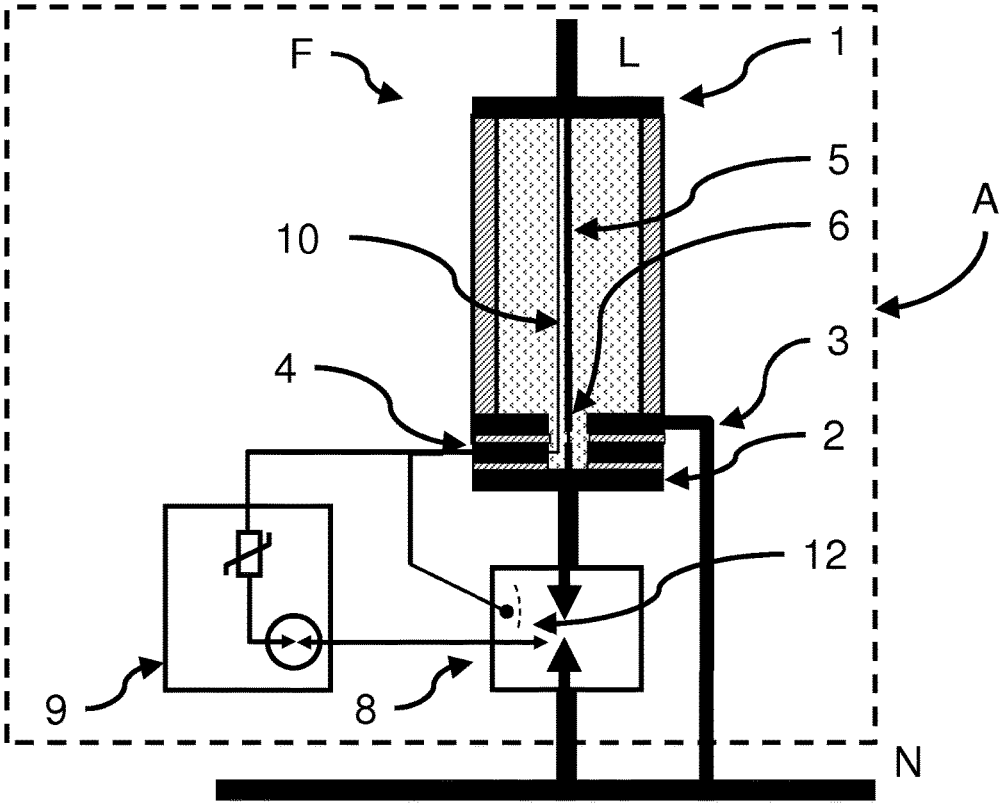
FIG. 4 shows a use of different embodiments of a fuse according to the invention with an exemplary overvoltage protection device.

FIGS. 1, 2 and 4 each show a schematic representation of a fuse F according to the invention.

The fuse F is connected in series with a device 8 to be protected, with the series connection being connected to a supply network with a first potential L and a second potential N that is different from the first. The potentials L and N can be any suitable alternating-current or direct-current potential. The potentials L and N thus form the supply network to which the series connection is connected.

The fuse F has a first contact 1 and a second contact 2. The second contact 2 is used to electrically contact the device 8 to be protected.

The fuse F also has a fuse element 5 that connects the first contact 1 to the second contact 2.

Moreover, the fuse F has at least one additional contact 3, with the additional contact 3 being arranged so as to be insulated from the first contact 1 and insulated from the second contact 2. In an untripped state of the fuse F, the additional contact 3 is contactless with respect to the fuse element 5.

During operation, the first contact 1 is directly connected to the first potential L and the device 8 to be protected is directly connected to the second potential N.

Moreover, the additional contact 3 is also directly connected to the second potential N during operation.

Furthermore, a fourth contact 4 is made available that provides external triggering, with the triggering indirectly or directly causing the fuse element 5 to fuse.

If a fault condition occurs—as a result of an overcurrent or a short circuit, for example—then the fuse element 5 disconnects. The resulting electric arc passes over to the additional contact 3 in the area of the latter. This is promoted, among other things, by the fact that the additional contact 3 has substantially the potential N, so that the voltage between the fuse element 5, which has substantially the potential L, is greater here than the potential of the second contact 2, which has substantially the same potential as the fuse element 5, with a reduction occurring here as a result of the voltage drop over the device 8 to be protected. This secondary electric arc will generally have a higher current, whereby the reliable disconnection of the fuse element and hence the protection of the device 8 is ensured.

On the other hand, it is also possible to use the fourth contact 4 for external triggering. In that case, the fourth contact 4 is in immediate proximity to the contact 2 and the additional contact 3, preferably as shown in FIGS. 1, 2 and 4.

The sequential arrangement can be set up as is suitable; for example, the additional contact 3 and the second contact 2 can be adjacent to the fourth contact, or the fourth contact is arranged above the additional contact, so the additional contact is adjacent to the second contact 2 and the fourth contact 4.

The fourth contact 4 is also introduced into the fuse in an insulated manner. The fourth contact 4 can act as an ignition spark gap for the area in which the contact 3 approaches the fuse element 5. This results in a triggerable fuse.

Without this constituting a restriction, the fuse element 5 or the contact 3, for example, can act as an electrical counter-contact to the fourth contact 4. For example, yet another contact (not shown) can also be provided that is insulated in relation to the second contact 2, the additional contact 3 and the fourth contact 4. Depending on the configuration, an ignition now occurs between the fourth contact 4 and the additional contact 3, between the fourth contact 4 and the fuse element 5, or between the fourth contact 4 and the other contact (not shown). The ignition can also be supported by resistive means as described in DE 10146728, for example, or by means of a high-voltage transformer pulse as shown in the applicant's DE 50 2005 008 658.

For this purpose, suitable triggering can be provided by means of an appropriately configured triggering device 9. For instance, if the device 8 to be protected detects a malfunction, the triggering device 9 can be activated. For example, a wide variety of monitoring mechanisms for electrical circuits and devices can be used to control the triggering device 9. Arc detection and temperature monitoring are noteworthy examples.

By virtue of the triggering, an ignition can be set off with relatively little energy, as a consequence of which a high-power electric arc occurs between the additional contact 3 and the fuse element 5, whereby the fuse element 5 disconnects to the point that the current is shut off.

Upon disconnection of the fuse element 5, a primary electric arc is formed there. This electric arc burns between the ends of the fuse element 5 formed at the point of separation. Under the effect of the electric arc, the disconnected ends of the fuse element 5 now burn off, and the electric arc lengthens. This process can take place at different speeds depending on the configuration and location of the disconnection. As a result of the ionization caused by the electric arc, the additional contact 3 is formed as a (new) base point of the electric arc if that has not already occurred.

The flow of current through the device 8 to be protected is thus interrupted. This ensures that, in case of a fault condition, the device 8 to be protected need only carry the energy corresponding to $I^2t$ that is required for the fusion and development of the first electric arc. If external triggering is provided by means of the triggering device 9, the current does not play any role in relation to the device 8 to be protected. This energy is substantially lower than the energy that would flow through the device by the time the fuse is quenched (pass integral).

This greatly relieves the load on the protected circuit.

In one advantageous embodiment, the fuse element 5 has a predetermined breaking point in the area of the additional contact 3.

In case of a short-circuit condition in the device to be protected, the fuse element 5 will now fuse in the area of the predetermined breaking point 6. Such predetermined breaking points 6 can be implemented by means of tapering and/or perforation of the fuse element 5. An electric arc forms and, here again, the electric arc burns off the two ends of the fuse element 5, thereby increasing in length. Ionization occurs as a result of the electric arc in the area of the contact 3 on the fuse element 5, so that the electric arc can choose the contact 3 as a new base point, or the contact 3 becomes the new base point due to low resistance (i.e., through appropriate dimensioning) and/or arrangement relative to the second contact. The flow of current through the device 8 to be protected is thus interrupted. This ensures that, in case of a fault condition, the device 8 to be protected need only carry the energy according to $I^2t$ that is required for the fusion of the predetermined breaking point 6 and development of the first electric arc. This energy is substantially lower than the energy that would flow through the device by the time the fuse is quenched (pass integral).

Especially advantageously, a provision can also be made that the fuse element 5 is filled with a quenching medium, particularly with sand and/or POM (polyoxymethylene). This improves the tripping characteristics in terms of both breaking capacity and speed, since improved cooling of the electric arc is now provided, whereby breaking capacity and speed can be improved.

In another embodiment of the invention, the additional contact 3 is disc-like, and the fuse element 5 is guided in an indentation or through an opening. This enables the manufacturing process to be structured in an especially simple and hence cost-effective manner. For example, the contact can be embodied as a disc with a substantially circular opening.

In another embodiment of the invention, the fourth contact 4 is disc-like, and the fuse element 5 is guided in an indentation or through an opening. This enables the manufacturing process to be structured in an especially simple and hence cost-effective manner. For example, the contact can be embodied as a disc with a substantially circular opening.

According to a development of the invention, which is shown in FIGS. 2 and 4, the fuse F can also have an auxiliary fuse element 10 that is electrically connected to the first contact 1 and is electrically connected to the fourth contact 4. In this way the mode of operation, e.g. in respect of a spark gap as a device 8 to be protected, may be improved.

This embodiment is especially suitable for protecting auxiliary circuits of high-capacity electrical devices. It can conceivably be used in the electronic measuring, control, regulation and safety devices of large motors and other high-performance loads having low-capacity auxiliary circuits in which the failure of the auxiliary circuit should, however, result in the immediate shutdown (emergency shut-off) of the main device.

In particular, the protection of ignition circuits of spark gaps is conceivable. As a rule, ignition circuits are designed to be substantially smaller in terms of their electrical parameters (e.g., their electrical cross section) than the main electrical path of the spark gap, since the backup fuse must, as a matter of principle, be dimensioned for the maximum surge current pulse to be discharged. For this reason, it can be necessary to protect ignition circuits using additional protective devices, which requires additional installation space. Moreover, the tripping of a protective device in the ignition circuit must also be signaled and optionally reported remotely, since the spark gap with the malfunctioning ignition circuit typically provides reduced protection. This adds considerable additional complexity, which can be minimized through the integration of the auxiliary fuse element into the backup fuse as a protection for the ignition circuit, and the protection can be additionally increased through the complete electrical isolation of the spark gap 8.

For example, the triggering device 9 for a spark gap can be embodied as a device 8 to be protected as shown in FIG. 4.

Various embodiments can be provided for the configuration of the fuse element 5 and the auxiliary fuse element 10. For instance, as shown in FIGS. 2 and 4, the fuse element 5 and the auxiliary fuse element can be arranged in the manner of wires so as to be parallel at least in sections, or, as shown on the left side of FIG. 3, the auxiliary fuse element 10 can be isolated in sections as a subportion from the fuse element 5. For example, the auxiliary fuse element 10 can be appropriately separated in sections from the fuse element 5 by means of die-cutting, partitioning, milling, or the like.

Figure 3:
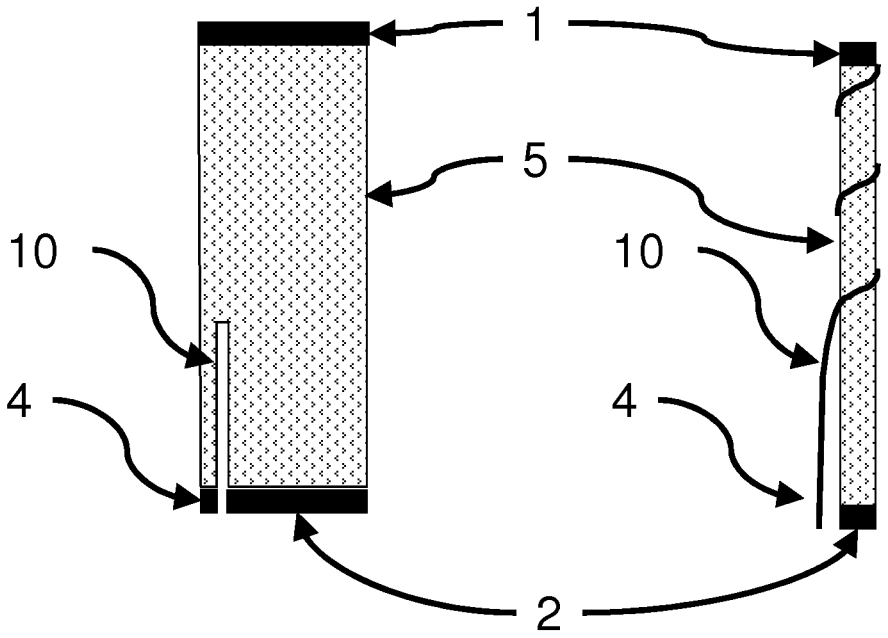
FIG. 3 shows details regarding embodiments of the invention.

Or, as shown to the right in FIG. 3, the auxiliary fuse element 10 can also enclose the fuse element 5 helically in sections.

In that case, the auxiliary fuse element 10 should be isolated from the fuse element 5 at least in the area in which the contact 3 approaches the fuse element 5, so that a substantially defined ignition point is present.

In addition, the fuse element 5 as well as the auxiliary fuse element 10 can also have one or more predetermined breaking points 6 in the area of the additional contact 3 and/or in the area of the fourth contact 4.

Especially advantageously, the fuse F according to the invention can be used in a fuse arrangement A, for example as shown in FIG. 4, which, besides the fuse F, also has the device 8 to be protected and a triggering device 9, which is connected to the fourth contact 4, and enables "external" triggering, that is, triggering that is not directly dependent on the main conductive path.

The device 8 to be protected can have an overvoltage protection device, for example a spark gap and/or a varistor and/or a transient voltage suppressor diode.

In the embodiment according to FIG. 4, a wear monitoring device 12 is further provided which is embodied, for example, as a contact protected by a degradable material. The triggering device 9 is then connected to the fourth contact 4, for example on the output side, to the wear monitoring device 12 of the spark gap 8.

In FIG. 4, both the ignition circuit and the wear monitoring device 12 are protected via the auxiliary fuse element 10, so that both in case of the overloading of the ignition circuit and of an overloading of the spark gap 8 on its interior, the spark gap 8 is disconnected completely from the network as a result of the tripping of the auxiliary fuse element 10 and the subsequent burning of the main fuse element 5.

In that case, upon overloading of the auxiliary fuse element 10 in the area of convergence between the contact 4 and the fuse element 5, an electric arc forms between the ends of the burnt auxiliary fuse element 10. By means of this electric arc, a second electric arc ignites between the fuse element 5 and the contact 3, which results in the burning of the fuse element 5, that is, to the tripping of the fuse. To improve the ignition behavior, the auxiliary fuse element 10 can have a predetermined breaking point 6 in the area in which the contact 3 approaches the fuse element 5 which, upon overloading of the fuse element, is the first to break, so that a first electric arc forms at this location. Therefore, if the fuse element 5 and the auxiliary fuse element 10 are dimensioned appropriately, it is possible to trip the high-current-compatible fuse F by means of a small tripping current in the fuse element 8 without the current having to flow through the device 8 to be protected until the high-current-compatible fuse F is tripped and quenched (pass integral $I^2t$). In particular, the auxiliary fuse element 10 can be supplied with current and tripped by switching devices in the device to be protected or a triggering device 9. This results in a triggerable fuse F.

The usual mechanisms for the insulated passage of potentials can be used to introduce the insulated potentials of the additional contact 3 and of the fourth contact 4. A layered construction of metal plates and insulating plates finished off with a fuse end plate is especially advantageous. In this construction, the different potentials can be introduced via the mutually insulated, stacked plates. The plate stack can be screwed in place, for example.

The tripping of the fuse can signaled using the usual mechanisms.

The invention presented herein can be used to particular advantage in the area of electromobility and for the generation of electrical energy by means of photovoltaics. Here, it is often the case that vehicles or facilities or equipment must meet certain safety criteria, for example in order not to pose a hazard to occupants or those providing help in the event of an accident or fire. An automatic or externally triggerable and high-performance shutoff of the power source can then be readily provided by the invention, as one example of a device 8 to be protected.

LIST OF REFERENCE SYMBOLS

Fuse F
First contact 1
Second contact 2
Additional contact 3
Fuse element 5
Predetermined breaking point 6
Device to be protected 8
Triggering device 9
Auxiliary fuse element 10
Wear monitoring device 12
First potential L
Second potential N
Fuse arrangement A

What is claimed is:

1. A fuse for a device to be protected that is connected in series with the fuse, wherein the series connection is connected to a supply network with a first potential and with a second potential that is different from the first, the fuse comprising:

a first contact;

a second contact;

an additional contact; and a fourth contact, wherein the second contact is used to electrically contact the device to be protected, wherein the fuse has a fuse element that connects the first contact to the second contact, wherein the additional contact is arranged so as to be insulated from the first contact and insulated from the second contact and, in an untripped state, is contactless with respect to the fuse element, wherein the first contact is directly connected to the first potential during operation and the device to be protected is directly connected to the second potential during operation, wherein the additional contact is also directly connected to the second potential during operation, wherein the fourth contact makes external triggering available, with triggering resulting in an electric arc that indirectly or directly causes the fuse element to fuse, and wherein the fuse also has an auxiliary fuse element that is electrically connected to the first contact and is electrically connected to the fourth contact.

2. The fuse as set forth in claim 1, wherein the additional contact is disc-like, and the auxiliary fuse element is guided in an indentation or through an opening in the additional contact.

3. A fuse arrangement having a fuse as set forth in claim 1 and the device to be protected, further comprising a triggering device that is connected to the fourth contact and that enables external triggering.

4. The fuse arrangement as set forth in claim 3, wherein the device to be protected has an overvoltage protection device.

5. The fuse arrangement as set forth in claim 4, wherein the overvoltage protection device is selected from a group which includes spark gaps, varistors, and transient voltage suppressor diodes.

6. The fuse arrangement as set forth in claim 4, wherein the overvoltage protection device is a spark gap with an auxiliary ignition electrode, wherein the triggering device has an ignition circuit, and wherein the ignition circuit is connected to the auxiliary ignition electrode of the spark gap.

* * * * *